US010801115B2

(12) United States Patent
Kubota et al.

(10) Patent No.: US 10,801,115 B2
(45) Date of Patent: Oct. 13, 2020

(54) TINNED COPPER TERMINAL MATERIAL, TERMINAL, AND ELECTRICAL WIRE END PART STRUCTURE

(71) Applicant: MITSUBISHI MATERIALS CORPORATION, Tokyo (JP)

(72) Inventors: Kenji Kubota, Naka (JP); Yoshie Tarutani, Naka (JP); Kiyotaka Nakaya, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 16/098,996

(22) PCT Filed: May 9, 2017

(86) PCT No.: PCT/JP2017/017515
§ 371 (c)(1),
(2) Date: Nov. 5, 2018

(87) PCT Pub. No.: WO2017/195768
PCT Pub. Date: Nov. 16, 2017

(65) Prior Publication Data

US 2019/0161866 A1 May 30, 2019

(30) Foreign Application Priority Data

May 10, 2016 (JP) ..... 2016-094713

(51) Int. Cl.
*C23F 15/00* (2006.01)
*C25D 5/12* (2006.01)
(Continued)

(52) U.S. Cl.
CPC ..... *C23F 15/00* (2013.01); *C22C 13/00* (2013.01); *C25D 5/12* (2013.01); *C25D 7/00* (2013.01);
(Continued)

(58) Field of Classification Search
CPC .. C23F 15/00; C25D 7/00; C25D 5/12; C25D 7/0607; C22C 13/00; H01B 1/026;
(Continued)

(56) References Cited

U.S. PATENT DOCUMENTS 6,613,451 B1 * 9/2003 Asahara ..... C23C 2/02 205/226
2003/0091855 A1 5/2003 Tanaka et al.
(Continued)

FOREIGN PATENT DOCUMENTS

EP 3382814 A1 10/2018
JP 01-259195 A 10/1989
(Continued)

OTHER PUBLICATIONS

"Effect of Ni Doping on Some Properties of Electrodeposited Zinc Alloy Coatings", Acta Metallurgica Slovaca, vol. 21, 2015, No. 3, pp. 226-235 (Diafi). (Year: 2015).*
(Continued)

*Primary Examiner* — Daniel J. Schleis
*Assistant Examiner* — Kevin C T Li
(74) *Attorney, Agent, or Firm* — Locke Lord LLP; James E. Armstrong, IV; Nicholas J. DiCeglie, Jr.

(57) ABSTRACT

A terminal material in which galvanic corrosion is not occurred using a copper or copper alloy base material as a terminal crimped to an end part of an electrical wire formed from an aluminum wire material: an intermediate zinc layer 4 formed from zinc or zinc alloy and a tin layer 5 formed from tin or tin alloy are layered in this order on a base material 2 formed from copper or copper alloy; the intermediate zinc layer 4 has a thickness of 0.1 μm to 5.0 μm inclusive and a zinc concentration equal to or more than 5 mass %; and the tin layer 5 has a zinc concentration of 0.4
(Continued)

mass % to 15 mass % inclusive and a grain size of the tin layer 5 is 0.1 μm to 3.0 μm inclusive preferably.

8 Claims, 4 Drawing Sheets

(51) Int. Cl.

| | |
|---|---|
| ***C25D 7/06*** | (2006.01) |
| ***C22C 13/00*** | (2006.01) |
| ***H01R 13/03*** | (2006.01) |
| ***H01B 7/00*** | (2006.01) |
| ***H01B 1/02*** | (2006.01) |
| ***H01R 4/18*** | (2006.01) |
| ***H01R 4/62*** | (2006.01) |
| ***C25D 7/00*** | (2006.01) |

(52) U.S. Cl.
CPC ..... *C25D 7/0607* (2013.01); *H01B 1/023* (2013.01); *H01B 1/026* (2013.01); *H01B 7/00* (2013.01); *H01R 4/18* (2013.01); *H01R 4/62* (2013.01); *H01R 13/03* (2013.01)

(58) Field of Classification Search
CPC . H01B 1/023; H01B 7/00; H01R 4/62; H01R 4/18; H01R 13/03
See application file for complete search history.

(56) References Cited

U.S. PATENT DOCUMENTS

| | | | | |
|---|---|---|---|---|
| 2005/0106408 | A1* | 5/2005 | Chen | C23C 28/321 428/629 |
| 2005/0211461 | A1 | 9/2005 | Horikoshi et al. | |
| 2007/0235207 | A1 | 10/2007 | Tsuji et al. | |
| 2012/0325552 | A1 | 12/2012 | Sakura | |
| 2014/0162505 | A1 | 6/2014 | Ohnuma | |
| 2016/0064847 | A1* | 3/2016 | Gaertner | B32B 15/013 439/741 |

FOREIGN PATENT DOCUMENTS

| | | | | | |
|---|---|---|---|---|---|
| JP | 07207841 | A | * | 8/1995 | C25D 5/12 |
| JP | 08-176883 | A | | 7/1996 | |
| JP | 2000144482 | A | | 5/2000 | |
| JP | 2003-171790 | A | | 6/2003 | |
| JP | 2003-293187 | A | | 10/2003 | |
| JP | 2004-134212 | A | | 4/2004 | |
| JP | 2005-216749 | A | | 8/2005 | |
| JP | 2007-299722 | A | | 11/2007 | |
| JP | 2008-285729 | A | | 11/2008 | |
| JP | 2009-084616 | A | | 4/2009 | |
| JP | 2009084616 | A | * | 4/2009 | |
| JP | 2011-222243 | A | | 11/2011 | |
| JP | 2013-033656 | A | | 2/2013 | |
| JP | 2014-164958 | A | | 9/2014 | |
| JP | 2014164958 | A | * | 9/2014 | |
| JP | 2015-103461 | A | | 6/2015 | |
| JP | 2015-133306 | A | | 7/2015 | |
| JP | 5817700 | B2 | * | 11/2015 | |
| JP | 2016-169439 | A | | 9/2016 | |
| WO | 2014/177563 | A1 | | 11/2014 | |
| WO | 2017/090638 | A1 | | 6/2017 | |

OTHER PUBLICATIONS

International Search Report dated Jun. 27, 2017, issued for PCT/JP2017/017515.
Notice of Reasons for Refusal issued in corresponding Japanese Patent Application No. JP 2017-092816, dated Mar. 3, 2020.
Extended European Search Report issued in corresponding European Patent Application No. EP 17796129.9, dated Nov. 12, 2019.
Office Action issued in corresponding Chinese Patent Application No. CN 201780024699.7, dated Jun. 1, 2020.

* cited by examiner

TINNED COPPER TERMINAL MATERIAL, TERMINAL, AND ELECTRICAL WIRE END PART STRUCTURE

BACKGROUND OF THE INVENTION

Technical Field

The present invention relates to a tinned copper terminal material for a terminal which is crimped to an end of an electrical wire formed from an aluminum wire material, the material in which tin or tin alloy is plated on a surface of a base material formed from copper or copper alloy, a terminal formed from the terminal material, and an electrical wire end part structure using the terminal.

Priority is claimed on Japanese Patent Application No. 2016-94713, filed May 10, 2016, the content of which is incorporated herein by reference.

Background Art

Conventionally, on an end part of an electrical wire formed from copper or copper alloy, a terminal formed from copper or copper alloy is crimped: connecting this terminal to a terminal provided at another equipment, the electrical wire is connected to the another equipment. For a purpose of reducing weight of the electrical wire or the like, there is a case in which the electrical wire is formed from aluminum or aluminum alloy instead of copper or copper alloy.

For example, Patent Document 1 discloses an aluminum electrical wire formed from aluminum alloy for a vehicle wire harness.

If the electrical wire (a conductive wire) is formed from aluminum or aluminum alloy and the terminal is formed from copper or copper alloy, there is a case in which galvanic corrosion occurs owing to a potential difference between different metals when water is drawn in a part where the terminal and the electrical wire are crimped. As the electrical wire is corroded, there is a risk of rising of electrical resistivity or reduction of a crimp power at the crimp part.

For example, Patent Document 2 and Patent Document 3 describe prevention methods of the corrosion. Patent Document 2 discloses a terminal formed from a base metal part formed from a first metal material, an intermediate layer formed from a second metal material having smaller standard electrode potential than that of the first metal material and thinly provided by plating at at least a part of a surface of the base metal part, and a surface layer formed from a third metal material having smaller standard electrode potential than that of the second metal material and thinly provided by plating at at least a part of a surface of the intermediate layer. It is described that: the first metal material is copper or alloy thereof; the second metal material is lead or alloy thereof, tin or alloy thereof, nickel or alloy thereof, or zinc or alloy thereof; and the third metal material is aluminum or alloy thereof.

Patent Document 3 discloses an end part structure of a wire harness in which in an end area of a coated electrical wire, a crimp part formed at one end of a terminal metal part is crimped along an outer circumference of a coated part of the coated electrical wire, and at least an end exposure area of the crimp part and all of outer circumference part in a vicinity area are entirely coated by mold resin.

An electric contact material for a connector disclosed in Patent Document 4 has a base material formed from a metal material, an alloy layer formed on the base material, and a conductive film layer formed on a surface of the alloy layer: the alloy layer essentially contains Sn and further contains one or two or more additive elements selected from Cu, Zn, Co, Ni, and Pd; and the conductive film layer contains hydroxy oxide of $Sn_3O_2(OH)_2$. It is described that by the conductive film layer including the hydroxy oxide of $Sn_3O_2(OH)_2$, durability under high temperature environment is improved and it is possible to maintain low contact resistance for a long time.

Patent Document 5 discloses an Sn plate material having an undercoat Ni plate layer, an intermediate Sn—Cu plate layer, and a surface Sn layer in this order on a surface of cupper or copper alloy: the undercoat Ni plate layer is formed from Ni or Ni alloy; the intermediate Sn—Cu plate layer is formed from an Sn—Cu group alloy in which an Sn—Cu—Zn alloy layer is formed at least at a side in contact with the surface Sn plate layer; and the surface Sn plate layer is formed from Sn alloy containing Zn with 5 to 1000 mass ppm and further has a Zn highly-concentrated layer with a Zn concentration of more than 0.1 wt % to 10 wt % on an outermost surface.

PRIOR ART DOCUMENTS

Patent Documents

Patent Document 1: Japanese Unexamined Patent Application, First Publication No. 2004-134212

Patent Document 2: Japanese Unexamined Patent Application, First Publication No. 2013-33656

Patent Document 3: Japanese Unexamined Patent Application, First Publication No. 2011-222243

Patent Document 4: Japanese Unexamined Patent Application, First Publication No. 2015-133306

Patent Document 5: Japanese Unexamined Patent Application, First Publication No. 2008-285729

SUMMARY OF INVENTION

Technical Problem

However, although the structure described in Patent Document 3 can prevent corrosion, a manufacturing cost is increased by an addition of a resin molding step: and further there is a problem in that the wire harness is hard to be reduced in size because a sectional area of a terminal is increased by the resin. There is a problem of high cost for performing aluminum group plating which is the third metal material described in Patent Document 2 because ionic liquid and the like are used.

Now, a tinned terminal material formed by tinning on a base formed from copper or copper alloy is used in many cases. In a case in which the tinned terminal material is to crimped to an aluminum-made electrical wire, it is expected that galvanic corrosion is hardly occurred since tin and aluminum have near corrosion potential to each other; however, the galvanic corrosion is occurred when a crimped part is wet by salt water or the like.

In this case, even when a hydroxy oxide layer of $Sn_3O_2(OH)_2$ is provided as in Patent Document 4, a hole is rapidly made in the hydroxy oxide layer when it is exposed to corrosive environment or heating environment, so that there is a problem of low durability. Moreover, if a Sn—Zn alloy is layered on a Sn Cu group alloy layer and a zinc highly-concentrated layer is formed at an outermost layer as in Patent Document 5, there are problems in that productivity of Sn—Zn alloy plating is low and a corrosion protection effect is disappeared against the aluminum wire material if copper in the Sn—Cu alloy layer is exposed at the surface layer.

The present invention is achieved in consideration of the above circumstances, and has an object to provide a tinned copper terminal material without galvanic corrosion if using a copper or copper alloy base material for a terminal crimped to an end of an electrical wire formed from an aluminum wire material, a terminal formed from the terminal material, and an electrical wire end part structure using the terminal.

Solution to Problem

A tinned copper terminal material according to the present invention includes an intermediate zinc layer formed from zinc or zinc alloy and a tin layer formed from tin or tin alloy layered in this order on a base material formed from copper or copper alloy; the tinned copper terminal material in which the intermediate zinc layer has a thickness of 0.1 μm to 5.0 μm inclusive and a zinc concentration not less than 5 mass %, and the tin layer has a zinc concentration of 0.4 mass % to 15 mass % inclusive.

In the tinned copper terminal material, since the tin layer at the surface contains zinc having corrosion potential nearer to that of aluminum than that of tin, an effect of preventing corrosion of an aluminum wire is high: and since the intermediate zinc layer formed from zinc or zinc alloy having corrosion potential relatively nearer to that of aluminum than that of a copper tin alloy layer is formed between the base material and the tin layer, it is possible to prevent galvanic corrosion even when the tin layer is disappeared, by the intermediate zinc layer.

If the zinc concentration in the tin layer is less than 0.4 mass %, the effect of preventing corrosion of the aluminum wire by lowering the corrosion potential is poor: if it exceeds 15 mass %, corrosion resistance of the tin layer is considerably deteriorated, and contact resistance is deteriorated since the tin layer is corroded if it is exposed in corrosive environment.

It is not desirable for the thickness of the intermediate zinc layer to be less than 0.1 μm because the base material is easy to be exposed after the tin layer is disappeared, so that galvanic corrosion occurs between copper in the base material and aluminum; and it is not desirable for the thickness to be more than 5.0 μm because press workability is deteriorated. If the zinc concentration of the intermediate zinc layer is less than 5 mass %, the corrosion resistance of the intermediate zinc layer is deteriorated, so that the intermediate zinc layer is rapidly corroded and disappeared when it is exposed in the corrosive environment such as salt water, and the base material is exposed, so that the galvanic corrosion is easy to be occurred with aluminum.

In the tinned copper terminal material of the present invention, it is desirable that corrosion potential be not more than −500 mV and not less than −900 mV to a silver-silver chloride electrode. It has an excellent corrosion protection effect since corrosion current is reduced low down.

In the tinned copper terminal material of the present invention, it is desirable that a grain size in the tin layer be 0.1 μm to 3.0 μm inclusive.

Zinc in the tin layer is diffused in the tin layer by a method such as diffusion treatment after zinc or zinc alloy plating and then tin plating. If the grain size of the tin layer is minute, the corrosion protection effect can be improved since zinc is easy to exist in a grain boundary thereof. If the grain size is less than 0.1 μm, the corrosion resistance of the tin layer is deteriorated since grain boundary density is too high and zinc is excessively diffused, so that there are problems in that the tin layer is corroded when it is exposed in the corrosive environment and the contact resistance with the aluminum wire is deteriorated. If the grain size exceeds 3.0 μm, the effect of preventing corrosion of the aluminum wire is deteriorated since zinc is not sufficiently diffused.

In the tinned copper terminal material according to the present invention, the tin layer is formed from a first tin layer arranged at a side to the base material and having a grain size not less than 0.1 μm and not more than 0.8 μm and a thickness not less than 0.1 μm and not more than 5.0 μm and a second tin layer arranged above the first tin layer and having a grain size more than 0.8 μm and not more than 3.0 μm and a thickness not less than 0.1 μm and not more than 5.0 μm.

Forming the tin layer to have a double layer structure and making the first tin layer in a lower layer thereof to have finer grains than that of the second tin layer, the first tin layer has more diffusion paths and contains much zinc, and the second tin layer has less zinc diffusion paths, so that the contact resistance at the surface by excessive diffusion of zinc to the surface is prevented from increasing and it is possible to show high anticorrosion property.

If the grain size in the first tin layer is less than 0.1 μm, zinc is excessively diffused and the contact resistance is increased: if it exceeds 0.8 μm, zinc is diffused insufficiently and the corrosion current is increased to some extent. If the grain size in the second tin layer is not more than 0.8 μm, zinc is excessively diffused and the contact resistance is slightly deteriorated: if it exceeds 3.0 μm, zinc is diffused insufficiently and the anticorrosion effect is deteriorated.

In the tinned copper terminal material of the present invention, the intermediate zinc layer is consist of zinc alloy containing one or more among nickel, manganese, molybdenum, tin, cadmium, and cobalt, and the zinc concentration is not less than 65 mass % and not more than 95 mass %.

Since the intermediate zinc layer is alloy containing one or more among these, the anticorrosion property of the intermediate zinc layer is improved while preventing excessive diffusion of zinc, so that a film is maintained for a long time and it is possible to prevent an increase of the corrosion current even when the tin layer is disappeared by exposure in corrosive environment. Nickel zinc alloy or tin zinc alloy are especially desirable since effect of improving the anticorrosion property of the intermediate zinc layer is high.

In the tinned copper terminal material of the present invention, it is preferable that a surface metal zinc layer be formed on the tin layer, and the surface metal zinc layer have a zinc concentration of 5 at % to 40 at % inclusive and a thickness of 1 nm to 10 nm inclusive in terms of $SiO_2$. It is possible to reduce the galvanic corrosion by contact with the aluminum electrical wire more reliably.

In the tinned copper terminal material of the present invention, an undercoat layer consist of nickel or nickel alloy is formed between the base material and the intermediate zinc layer, and the undercoat layer has a thickness 0.1 μm to 5.0 μm inclusive and a nickel content rate not less than 80 mass %.

The undercoat layer between the base material and the intermediate zinc layer has a function of preventing diffusion of copper from the base material formed from copper or copper alloy to the intermediate zinc layer and the tin layer. If the thickness of the undercoat layer is less than 0.1 μm, the effect of preventing the diffusion of copper is poor: if it exceeds 5.0 μm, breakage is easy to occur when pressing. If the nickel content rate is less than 80 mass %, the effect of preventing the diffusion of copper to the intermediate zinc layer and the tin layer is poor.

In the tinned copper terminal material of the present invention, to a carrier part formed to have a belt shape and following a long direction, a plurality of terminal members formed to be terminals by pressing are respectively connected, in a state of being arranged with space along the long direction of the carrier part long direction.

A terminal of the present invention is a terminal formed from the above described tinned copper terminal material: an electrical wire end part structure of the present invention is crimped to an end part of an electrical wire formed from aluminum or aluminum alloy.

Advantageous Effects of Invention

According to the tinned copper terminal material of the present invention, since the tin layer at the surface contains zinc, the corrosion protection effect to the aluminum-made electrical wire is improved; since the intermediate zinc layer is provided between the tin layer and the base material, even when the tin layer is disappeared, the galvanic corrosion with the aluminum-made electrical wire is prevented and it is possible to prevent the increase of the electrical resistance and deterioration of a fix force.

DESCRIPTION OF EMBODIMENTS

A tinned copper terminal material, a terminal, and an electrical wire end part structure of an embodiment of the present invention will be explained.

Figure 2:
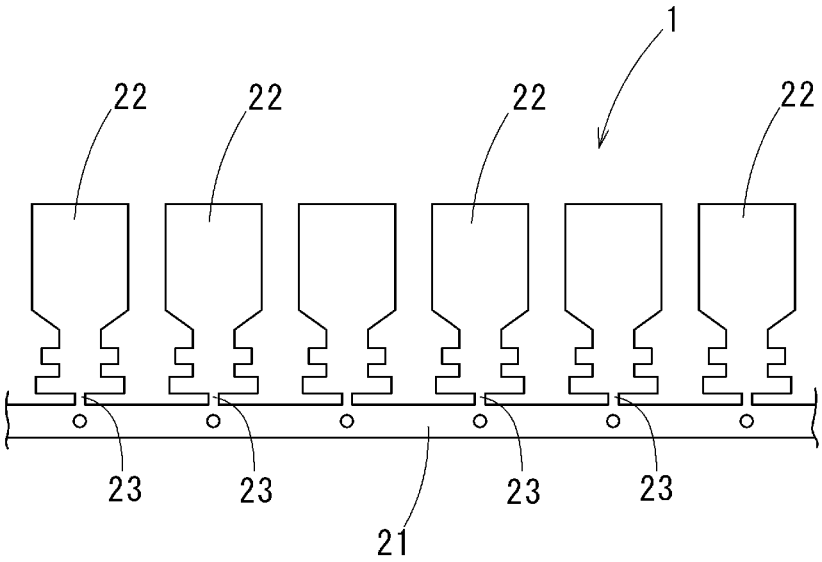
FIG. 2 It is a plan view of a terminal material of an embodiment.

A tinned copper terminal material 1 of the present embodiment is, as generally shown in FIG. 2, a strip material formed in a belt-plate shape in order to form a plurality of terminals. On a carrier part 21 along a length direction, a plurality of terminal members 22 formed to be terminals are arranged with space in a length direction of the carrier part 21. The terminal members 22 are connected to the carrier part 21 through narrow width coupling parts 23. The terminal members 22 are formed into a shape of a terminal 10 shown in FIG. 3, and cut off from the coupling parts 23 so as to be completed as the terminals 10.

Figure 3:
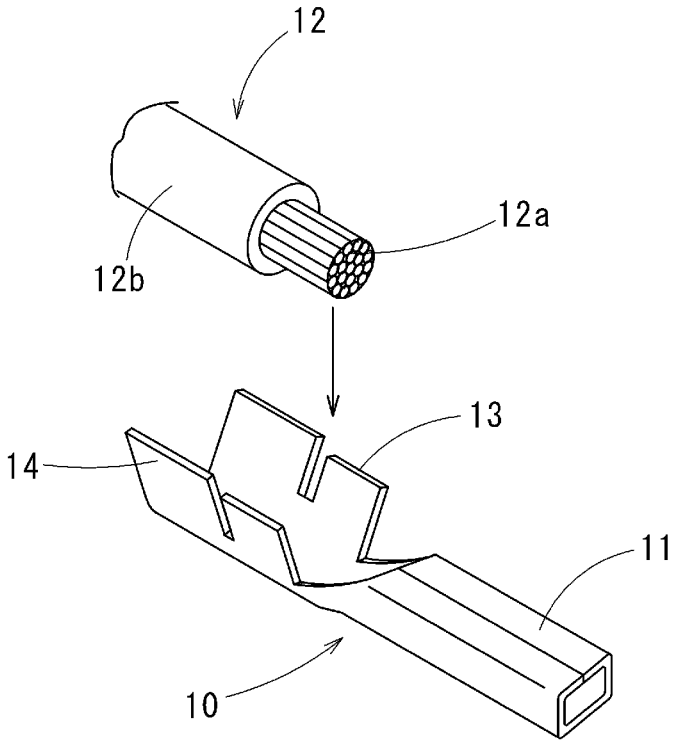
FIG. 3 It is a perspective view showing an example of a terminal in which a terminal material of an embodiment is applied.

The terminal 10 is shown as a female terminal in an example of FIG. 3. On each of the terminals 10, a connector part 11 to which a male terminal (not illustrated) is crimped, a core wire crimp part 13 to which an exposed core wire 12*a* of an electrical wire 12 is crimped, and a sheath crimp part 14 to which a sheath part 12*b* of the electrical wire 12 is crimped are integrally formed in this order from a tip.

Figure 4:
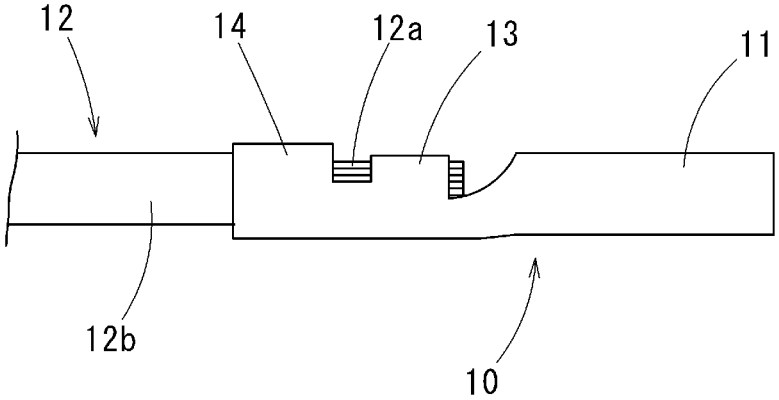
FIG. 4 It is a front view showing an end part of an electrical wire to which the terminal of FIG. 3 is crimped.

FIG. 4 shows an end part structure in which the terminal 10 is crimped to the electrical wire 12. The core wire crimp part 13 is in direct contact with the core wire 12*a*.

Figure 1:
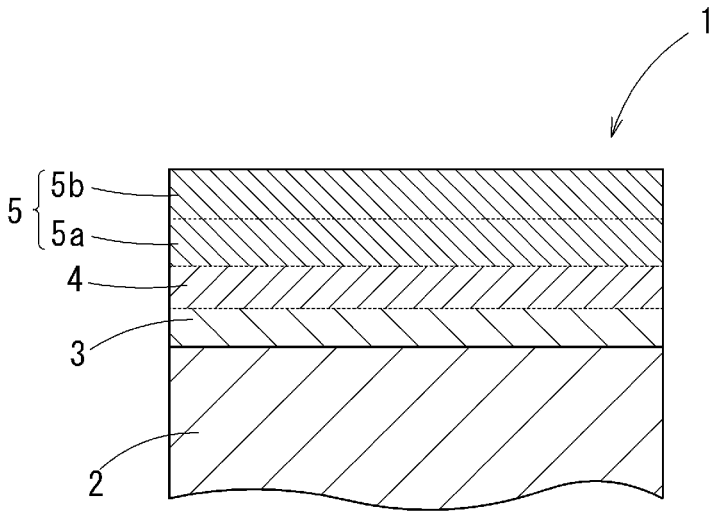
FIG. 1 It is a sectional view schematically showing an embodiment of a tinned copper alloy terminal material according to the present invention.

The tinned copper terminal material 1 is formed by laying an undercoat layer 3 formed from nickel or nickel alloy, an intermediate zinc layer 4 formed from zinc or zinc alloy, and a tin layer 5 in this order on a base material 2 formed from copper or copper alloy, as FIG. 1 schematically shows the section.

The base material 2 is sufficient to be formed from copper or copper alloy: composition thereof is not specially limited.

The undercoat layer 3 has a thickness of 0.1 μm to 5.0 μm inclusive, and a nickel content rate of 80 mass % or more. The undercoat layer 3 has a function of preventing diffusion of copper from the base material 2 to the intermediate zinc layer 4 and the tin layer 5: if the thickness thereof is less than 0.1 μm, an effect of preventing the diffusion of copper is poor; if it exceeds 5.0 μm, breakage may be easily occur while pressing. The thickness of the undercoat layer 3 is more desirable to be 0.3 μm to 2.0 μm inclusive.

If the nickel content rate of the undercoat layer 3 is less than 80 mass %, the effect of preventing diffusion of copper to the intermediate zinc layer 4 and the tin layer 5 is poor. The nickel content rate is more desirable to be 90 mass % or more.

The intermediate zinc layer 4 has a thickness of 0.1 μm to 5.0 μm inclusive, and a zinc concentration of 5 mass % or more. If the thickness of the intermediate zinc layer 4 is less than 0.1 μm, there is no effect of lowering corrosion potential at a surface: if it exceeds 5.0 μm, there is a risk in that a breakage may occur while a pressing process of the terminals 10. The thickness of the intermediate zinc layer 4 is more preferable to be 0.3 μm to 2.0 μm inclusive.

If the zinc concentration in the intermediate zinc layer 4 is less than 5 mass %, corrosion resistance of the intermediate zinc layer 4 is deteriorated, the intermediate zinc layer 4 is rapidly corroded and disappeared when it is exposed to corrosive environment such as salt water, so that the base material is exposed and the galvanic corrosion with aluminum is easy to occur. More preferably, the zinc concentration of the intermediate zinc layer be 65 mass % or more.

It is preferable that the intermediate zinc layer 4 be zinc alloy including one or more among nickel, manganese, molybdenum, tin, cadmium, and cobalt.

These nickel, manganese, molybdenum, tin, cadmium, and cobalt are desirable to improve the corrosion resistance of the intermediate zinc layer. Since the intermediate zinc layer 4 is alloy including one or more among these, even when the tin layer is disappeared by exposing to excessive corrosive environment, it is possible to maintain a film and prevent increase of corrosion current. In this case, it is preferable that an additive consist of one or more among nickel, manganese, molybdenum, tin, cadmium and cobalt be contained 5 mass % or more in the intermediate zinc layer 4. Accordingly, the zinc concentration of the intermediate zinc layer 4 is 5 mass % to 95 mass % inclusive; preferably, 65 mass % to 95 mass % inclusive.

The tin layer 5 has a zinc concentration of 0.4 mass % to 15 mass % inclusive. If the zinc concentration of the tin layer 5 is less than 0.4 mass %, an effect of preventing an aluminum wire from corrosion by lowering corrosion potential is poor; if it exceeds 15 mass %, the corrosion resistance of the tin layer 5 is remarkably deteriorated, so that the tin layer 5 is corroded if it is exposed to corrosive environment, and contact resistance is deteriorated. The zinc concentration of the tin layer 5 is more preferable to be 1.5 mass % to 6.0 mass % inclusive.

It is preferable that a thickness of the tin layer 5 be 0.2 μm to 10.0 μm inclusive: if it is to thin, there is a risk in that solder wettability is deteriorated and contact resistance is increased: if it is too thick, dynamic friction coefficient at a surface is increased, and attaching/detaching resistance when it is used for a connector and the like is tend to be large.

It is desirable that grain size in the tin layer 5 be 0.1 μm to 3.0 μm inclusive; 0.3 μm to 2 μm inclusive is especially desirable. In a diffusion treatment described below, it is possible to improve an anticorrosion effect by zinc in grain boundaries in the tin layer 5. If the grain size is less than 0.1 μm, grain boundary density is too high, so that the diffusion of zinc is excessive and the corrosion resistance of the tin layer is deteriorated, the tin layer is corroded when it is exposed to corrosive environment, and contact resistance with an aluminum wire may be deteriorated. If the grain size is more than 3.0 μm, the diffusion of zinc is not sufficient and the effect of preventing the corrosion of the aluminum wire is poor.

The tin layer 5 has a stacked structure of a first tin layer 5*a* formed on the intermediate zinc layer 4 and a second tin layer 5*b* formed thereon. The first tin layer 5*a* is formed to have a grain size of 0.1 μm to 0.8 μm inclusive, and a thickness of 0.1 μm to 5.0 μm inclusive. The second tin layer 5*b* is formed to have a grain size more than 0.8 μm and not more than 3.0 μm and a thickness of 0.1 μm to 5.0 μm inclusive.

Since the tin layer 5 has the double layer structure and the lower first tin layer 5*a* has more minute grains than that of the upper second tin layer 5*b*; the first tin layer 5*a* has many diffusion paths and contains much zinc and the second tin layer 5*b* has less zinc diffusion paths; so that it is possible to show high anticorrosion property while preventing increase of contact resistance at a surface by excessive diffusion of zinc to the surface. Although it is most desirable that the tin layer 5 be pure tin; it is also possible to be formed from tin alloy containing zinc, nickel, copper and the like.

The tinned copper terminal material 1 having the above structure has an excellent anticorrosion effect since corrosion potential is not more than −500 mV and not less than −900 mV inclusive (−500 mV to −900 mV) to a silver-silver chloride electrode and corrosion potential of aluminum is −700 mV to −900 mV inclusive.

Next, a manufacturing method of the tinned copper terminal material 1 will be explained. A plate material formed from copper or copper alloy is prepared as the base material 2. The plate material is formed, by processing of cutting, perforation and the like, into a strip material in which the plurality of terminal members 22 are connected to the carrier part 21 through the coupling parts 23, as shown in FIG. 2. After cleaning a surface of the strip material by degreasing, pickling and the like, nickel or nickel alloy plating forming the undercoat layer 3, zinc or zinc alloy plating forming the intermediate zinc layer 4, and tin or tin alloy plating forming the tin layer 5 are performed in this order.

In order to form the undercoat layer 3, nickel or nickel alloy plating is not specially limited if a dense film of nickel as a main constitute can be obtained; it can be formed by electroplating using a known a Watts bath, a sulfamate bath, a citrate bath, or the like. For nickel alloy plating, nickel tungsten (Ni—W) alloy, nickel phosphor (Ni—P) alloy, nickel cobalt (Ni—Co) alloy, nickel chromium (Ni—Cr) alloy, nickel ferrous (Ni—Fe) alloy, nickel zinc (Ni—Zn) alloy, nickel boron (Ni—B) alloy and the like can be utilized. Considering a press bending property on the terminals 10 and a barrier property to copper, pure nickel plating obtained from the sulfamate bath is desirable.

For forming the intermediate zinc layer 4, zinc or zinc alloy plating is not specially limited if a dense film can be obtained with a desired composition: a known sulfate bath, a chloride bath, a zincate bath or the like can be utilized for zinc plating. For zinc alloy plating, a cyanogen bath for zinc copper alloy plating; a sulfate bath, a chloride bath, and an alkaline bath for zinc nickel alloy plating; and a complexing agent bath including citric acid and the like for tin zinc alloy plating can be utilized. Films can be formed by the sulfate bath for zinc cobalt alloy plating, by the sulfate bath including citric acid for zinc manganese alloy plating, and by the sulfate bath for zinc molybdenum plating.

For forming the tin layer 5, tin or tin alloy plating can be performed by a known method: for example, an organic acid bath (for example, a phenol sulfonic acid bath, an alkane sulfonic acid bath, or an alkanol sulfonic acid bath), an acidic bath such as a fluorobrate bath, a halogen bath, a sulphate bath, a pyrophosphoric acid bath or the like, or an alkaline bath such as a potassium bath, a sodium bath or the like can be used in electroplating. In a case in which a grain size in the tin layer 5 is controlled to 0.8 μm or less, it is preferable to add aldehydes such as formalin, benzaldehyde, naphthaldehyde or the like, or unsaturated hydrocarbon compound such as methacrylic acid, acrylic acid or the like be added as an additive to reduce the grain size.

As above, nickel or nickel alloy plating, zinc or zinc alloy plating, and tin or tin alloy plating are performed on the base material 2 in this order; and then, a heat treatment is performed.

The heat treatment is performed at temperature so that surface temperature of a raw material is 30° C. to 190° C. inclusive. By this heat treatment, zinc in the zinc plating or zinc alloy plating layer is diffused in the tin plating layer. Zinc is rapidly diffused, so that it is sufficient to be exposed at temperature 30° C. or higher for 24 hours or longer. However, zinc alloy repels melted tin so that a tin-repelled part is formed at the tin layer 5, it is not heated to temperature higher than 190° C. If it is heated for a long time at higher than 160° C., there is a risk that diffusion of zinc is obstructed because tin is conversely diffused to the intermediate zinc layer side. Accordingly, more preferable conditions are heating temperature of 30° C. to 160° C. inclusive, and a holding time of 30 minutes to 60 minutes inclusive.

In the tinned copper terminal material 1 manufactured as above, as a whole, on the base material 2, the undercoat layer 3 formed from nickel or nickel alloy, the intermediate zinc layer 4 formed from zinc or zinc alloy, and the tin layer 5 are laminated in this order.

Then, the shape of the terminal 10 shown in FIG. 3 is formed by pressing and the like on the strip material, and formed into the terminals 10 by cutting the coupling parts 23.

FIG. 4 shows an end part structure in which the terminal 10 is crimped to the electrical wire 12: the core wire crimp part 13 is directly in contact with the core wire 12*a* of the electrical wire 12.

Since the tin layer 5 contains zinc having the corrosion potential nearer to that of aluminum than that of tin, even in a case in which the terminal 10 is crimped to the aluminum-made core wire 12*a*, the effect of preventing the corrosion of the aluminum wire is high and the galvanic corrosion can be prevented effectively.

Since it is plated and heat treated in a state of the strip material of FIG. 2, the base material 2 is not exposed even at an end surface of the terminal 10, so that the excellent anti-corrosion effect can be shown.

Moreover, since the intermediate zinc layer 4 is formed under the tin layer 5, and the intermediate zinc layer 4 has the near corrosion potential to that of aluminum; even if all or a part of the tin layer 5 is disappeared at the worst by abrasion and the like, the galvanic corrosion can be reliably prevented.

The present invention is not limited to the above-described embodiments and various modifications may be made without departing from the scope of the present invention.

Figure 5:
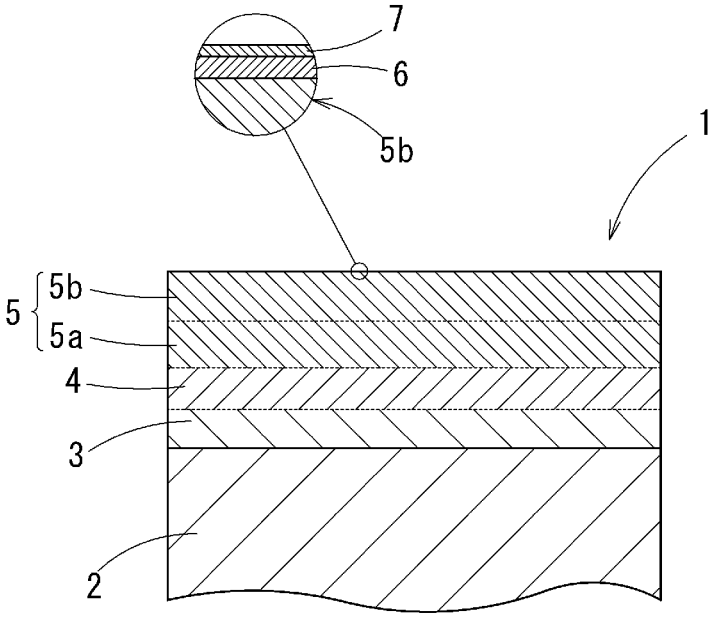
FIG. 5 It is a sectional view schematically showing another embodiment of the present invention.

For example, an outermost surface is formed by the tin layer 5 in the above embodiment though: a surface metal zinc layer 6 may be further formed on the tin layer 5 as shown in FIG. 5. The surface metal zinc layer 6 is formed on the surface of the tin layer 5 by diffusing zinc in the zinc plating or zinc alloy plating layer to the surface through the tin plating layer by the above described heat treatment: zinc concentration is 5 at % to 40 at % inclusive and a thickness is 1 nm to 10 nm inclusive in terms of $SiO_2$. Since the surface is formed of the surface metal zinc layer, the galvanic corrosion by the contact with the aluminum-made electrical wire can be more reliably prevented. In addition, a thin oxide layer 7 is formed on the surface metal zinc layer 6.

EXAMPLES

Using a copper plate of C1020 as a base material, after degreasing and pickling, nickel plating was performed in a case in which the undercoat layer would be formed, and then zinc plating or zinc alloy plating, and tin plating were performed in order. Principal conditions of plating were as follows. Zinc content rate in the intermediate zinc layer was controlled by varying a ratio between zinc ion and additive alloy element ion in a plating bath. The following condition of zinc nickel alloy plating is an example of the zinc concentration is 15 mass %. Tin plating was a single layer in Samples 1 to 5, 15, and 17 to 20: in Samples 6 to 14, and 16, tin plating was a double layer structure in which grain sizes were different. On Sample 17, zinc or zinc plating was not performed: after degreasing and pickling of the copper plate, nickel plating and tin plating were performed in order. Nickel plating for the undercoat layer was not performed on Samples 1 to 13. As a sample in which nickel alloy plating was performed on the undercoat layer, nickel-phosphorus plating was performed on Sample 16.

—Nickel Plating Condition—
Composition of Plating Bath
nickel sulfamate: 300 g/L
nickel chloride: 5 g/L
boric acid: 30 g/L
Bath Temperature: 45° C.
Current Density: 5 A/dm$^2$
—Zinc Plating Condition—
zinc sulfate heptahydrate: 250 g/L
sodium sulfate: 150 g/L
pH=1.2
Bath Temperature: 45° C.
Current Density: 5 A/dm$^2$
—Nickel Zinc Alloy Plating Condition—
Composition of Plating Bath
zinc sulfate heptahydrate: 75 g/L
nickel sulfate hexahydrate: 180 g/L
sodium sulfate: 140 g/L
pH=2.0
Bath Temperature: 45° C.
Current Density: 5 A/dm$^2$
—Tin Zinc Alloy Plating Condition—
Composition of Plating Bath
tin (□) sulfate: 40 g/L
zinc sulfate heptahydrate: 5 g/L
trisodium citrate: 65 g/L
nonionic surfactant: 1 g/L
pH=5.0
Bath Temperature: 25° C.
Current Density: 3 A/dm$^2$
—Zinc Manganese Alloy Plating Condition—
Composition of Plating Bath
manganese sulfate monohydrate: 110 g/L
zinc sulfate heptahydrate: 50 g/L
torisodium citrate: 250 g/L
pH=5.3
Bath Temperature: 30° C.
Current Density: 5 A/dm$^2$
—Tin Plating Condition—
Composition of Plating Bath
stannous methanesulfonate: 200 g/L
methanesulfonic acid: 100 g/L
additive
Bath Temperature: 35° C.
Current Density: 5 A/dm$^2$ Then, the heat treatment was performed on the copper plates with the plating layer in a range of temperature 30° C. to 160° C., 60 minutes or shorter so as to be Samples shown in Table 1.

For the obtained samples, measured were the thicknesses of the undercoat layer and the intermediate zinc layer, the nickel content in the undercoat layer, the zinc concentrations in the intermediate zinc layer and the tin layer, the grain size in the tin layer, the thickness and the zinc concentration of the surface metal zinc layer on the tin layer, and the corrosion potential at the surface.

The thicknesses of the undercoat layer and the intermediate zinc layer were measured by observing a section by a scanning ion microscope. The nickel content rates of the intermediate zinc layer and the undercoat layer were measured as follows. Using a focused ion beam device "FIB" made by Seiko Instruments Inc. (model number: SMI3050TB), observing pieces in which Samples were thinned down to 100 nm or less were formed. The observing pieces were observed at acceleration voltage 200 kV by using a scanning transmission electron microscope "STEM" made by JEOL Ltd. (model number: JEM-2010F), and measured by an energy dispersive X-ray spectrometer "EDS" (made by Thermo) attached to the STEM.

The zinc concentration in the tin layer was measured at a surface of Samples by using an electron probe micro analyzer made by JEOL Ltd.: EPMA (model number JXA-8530F), at the acceleration voltage 6.5 V, a beam diameter 30 μm.

Regarding the grain size in the tin layer, a section treatment was performed by the focused ion beam device (FIB), drawing a line parallel to a surface with a length 5 μm using a measured image of the scanning ion microscope (SIM), it was obtained by linear analysis using a number in which the line crossed the grain boundary. The first tin layer and the second tin layer were distinguished by boundaries appearing on the SIM image.

Regarding the thickness and the concentration of the surface metal zinc layer, an XPS (X-ray Photoelectron Spectroscopy) analyzer made by Ulvac-phi, Inc.: ULVAC PHI model-5600LS was used for measuring Samples by the XPS analyzing while etching the surface of Samples by Argon ion. The condition of analyzing was as follows.

X-ray source: Standard MgKα 350 W

Path Energy: 187.85 eV (Survey), 58.70 eV (Narrow)

Measuring Step: 0.8 eV/step (Survey), 0.125 eV (Narrow)

Photoelectron Extraction Angle to Sample Surface: 45 deg

Analyzing Area: about 800 μm diameter

Regarding thickness, using an etching rate of $SiO_2$ previously measured by the same device, a "film thickness in terms of $SiO_2$" was calculated from a duration for measuring.

A calculating method of the etching rate of $SiO_2$ was calculated by: etching a film of $SiO_2$ with a thickness 20 nm on a rectangle region of 2.8×3.5 mm by argon ion, and dividing by time for etching the film of $SiO_2$ at 20 nm. In the above-described analyzing device, the etching rate is 2.5 nm/min since it took 8 minutes. XPS is excellent in depth resolution as about 0.5 nm though, etching time by Ar ion beam is different according to materials: in order to obtain a value of film thickness itself, flat samples with already-known film thickness should be prepared and an etching rate should be calculated. Since it is not easy to do as above mentioned, utilizing the etching rate obtained from the $SiO_2$ film having the already-known film thickness; and the "film thickness in terms of $SiO_2$" was calculated from the time for etching. Therefore, it would be necessary to be careful that the "film thickness in terms of $SiO_2$" is different from a real film thickness of oxide. By obtaining the film thickness from the etching rate in terms of $SiO_2$, even though the real film thickness is uncertain, the film thickness can be quantitatively evaluated since it is uniquely defined.

The corrosion potential was measured by: cutting out Samples into 10×50 mm; coating copper exposed parts such as the end surfaces by epoxy resin and then soaking it in a sodium chloride solution with 23° C. 5 mass %; and measuring by a function of measuring spontaneous-potential in HA1510 made of Hokuto Denko Corporation. As a reference electrode, used was a silver-silver chloride electrode (Ag/AgCl electrode) made by Metrohme, which is a double junction type in which a saturated potassium chloride solution is filled for inner tower liquid. Measuring results are shown in Table 1.

TABLE 1

| | Undercoat Layer | | Intermediate Zinc Layer | | | First Tin Layer | | Second Tin Layer | | Tin | Surface Metal Zinc Layer Film Thickness | | Corrosion |
|---|---|---|---|---|---|---|---|---|---|---|---|---|---|
| | Ni | | Zn | | | | | | | | | | |
| Samples No. | Thickness (μm) | Content Rate | Thickness (μm) | Content Rate | Alloy Type | Thickness (μm) | Grain Size (μm) | Thickness (μm) | Grain Size (μm) | Layer Zn Content Rate (%) | (μm) In Terms of $SiO_2$ | Concentration (at %) | Potential (mV vs. Ag/AgCl) |
| 1 | — | — | 0.10 | 60 | Zn—Cu | 1.0 | 4.00 | — | — | 0.6 | 0.5 | 3.0 | −550 |
| 2 | — | — | 2.00 | 5 | Zn—Fe | 1.0 | 3.30 | — | — | 0.4 | 0.5 | 1.0 | −510 |
| 3 | — | — | 5.00 | 100 | Zn | 1.0 | 9.00 | — | — | 15 | 18.0 | 55.0 | −890 |
| 4 | — | — | 3.00 | 100 | Zn | 2.0 | 0.10 | — | — | 9 | 12.0 | 50.0 | −750 |
| 5 | — | — | 3.00 | 100 | Zn | 3.0 | 3.00 | — | — | 5 | 0.5 | 3.0 | −650 |
| 6 | — | — | 2.00 | 50 | Zn—Cu | 0.1 | 0.40 | 5.0 | 3.00 | 8 | 0.5 | 3.0 | −700 |
| 7 | — | — | 2.00 | 100 | Zn | 5.0 | 0.70 | 0.1 | 0.85 | 2 | 0.5 | 3.0 | −590 |
| 8 | — | — | 2.00 | 65 | Zn—Sn | 2.0 | 0.50 | 2.0 | 0.90 | 6 | 0.5 | 4.0 | −610 |
| 9 | — | — | 2.00 | 90 | Zn—Ni | 2.0 | 0.50 | 2.0 | 2.50 | 3 | 0.5 | 3.0 | −600 |
| 10 | — | — | 2.00 | 80 | Zn—Mn | 1.0 | 0.20 | 1.0 | 0.90 | 10 | 12.0 | 50.0 | −810 |
| 11 | — | — | 2.00 | 70 | Zn—Mo | 1.0 | 0.60 | 1.0 | 2.50 | 2 | 0.5 | 2.0 | −580 |
| 12 | — | — | 2.00 | 75 | Zn—Cd | 1.0 | 0.30 | 1.0 | 2.10 | 5 | 1.0 | 5.0 | −620 |
| 13 | — | — | 2.00 | 95 | Zn—Co | 1.0 | 0.50 | 1.0 | 1.50 | 4 | 10.0 | 40.0 | −600 |
| 14 | 0.10 | 100 | 1.00 | 80 | Zn—Ni | 3.0 | 0.50 | 2.0 | 1.80 | 6 | 3.2 | 12.0 | −710 |
| 15 | 1.00 | 100 | 0.50 | 75 | Zn—Ni | 2.0 | 0.25 | — | — | 3 | 10.0 | 40.0 | −680 |
| 16 | 5.00 | 90(Ni—P) | 1.00 | 65 | Zn—Sn | 4.0 | 0.40 | 1.0 | 1.50 | 4 | 5.0 | 25.0 | −650 |
| 17 | 1.00 | 100 | — | — | — | 2.0 | 2.00 | — | — | 0 | Unmeasurable | Unmeasurable | −420 |
| 18 | 2.50 | 70(Ni—Fe) | 5.20 | 96 | Zn—Ni | 2.0 | 0.05 | — | — | 18 | 25.0 | 68.0 | −950 |
| 19 | 0.05 | 100 | 0.05 | 10 | Zn—Ni | 2.0 | 0.30 | — | — | 0.1 | 0.5 | 3.0 | −450 |
| 20 | 6.00 | 100 | 6.00 | 58 | Zn—Ni | 3.0 | 5.00 | — | — | 0.3 | 0.8 | 12.0 | −480 |

For obtained Samples, performed were measurement and evaluation of corrosion current, bending workability, and contact resistance.

—Corrosion Current—

Corrosion Current was measured by: arranging a pure aluminum wire coated with resin except for an exposed part of a diameter 2 mm and Samples coated with resin except for an exposed part of a diameter 6 mm so as to face the exposed parts to each other with a distance 1 mm; and measuring the corrosion current between the aluminum wire and Samples in 23° C. 5 mass % salt water. HA1510, a zero shunt ammeter made by Hokuto Denko Corporation was used for measuring corrosion current, and the corrosion currents after heating Samples at 150° C. for 1 hour and that before heating. Average current for 1000 minutes was compared with average current for further longer 1000 to 3000 minutes test was performed.

—Bending Workability—

For bending workability, cutting out a test piece so that a rolling direction is to be a longitudinal direction, it was performed to bend at a load 9.8×103 N perpendicular to the rolling direction using a W bending test tool provided in JISH3110. Then, observation was performed by using a stereoscopic microscope. Evaluation of the bending workability was as follows. If there was no definite crack at a bend part after the test, it was "EXCELLENT": even though there was a crack, if the copper alloy mother material was not exposed at the crack, it was "GOOD": if the copper alloy mother material was exposed at the crack, it was "BAD".

—Contact Resistance—

A measurement method of contact resistance was performed conforming JCBA-T323, using a four-terminal contact-resistance test device (CRS-113-AU made by Yamasaki-Seiki Institute, Inc.), and measuring contact resistance by sliding type (1 mm) at a load 0.98 N. Plated surfaces of flat plate samples were measured. Results of them are shown in Table 2.

TABLE 2

| | Corrosion Current | | | | |
|---|---|---|---|---|---|
| | 0~1000 min. Average | | 1000~3000 min. Average | | Contact |
| Samples No. | Before Heating | After Heating | Before Heating | Bending Workability | Resistance (m Ω) |
| 1 | 4.0 | 7.5 | 6.0 | EXCELLENT | 1.8 |
| 2 | 3.5 | 6.9 | 4.5 | EXCELLENT | 1.6 |
| 3 | 3.9 | 8.0 | 5.0 | EXCELLENT | 1.8 |
| 4 | 1.2 | 5.5 | 2.0 | EXCELLENT | 1.9 |
| 5 | 2.5 | 6.5 | 2.6 | EXCELLENT | 1.8 |
| 6 | 1.3 | 7.8 | 3.1 | EXCELLENT | 0.9 |
| 7 | 1.9 | 5.5 | 2.5 | EXCELLENT | 0.6 |
| 8 | 1.8 | 3.9 | 1.9 | EXCELLENT | 0.8 |
| 9 | 0.6 | 4.3 | 1.1 | EXCELLENT | 0.5 |
| 10 | 0.9 | 3.1 | 1.5 | EXCELLENT | 1.1 |
| 11 | 1.1 | 3.5 | 1.2 | EXCELLENT | 0.8 |
| 12 | 1.0 | 3.6 | 1.4 | EXCELLENT | 0.9 |
| 13 | 1.2 | 2.9 | 1.3 | EXCELLENT | 1.3 |
| 14 | 0.5 | 1.0 | 0.8 | EXCELLENT | 0.6 |
| 15 | 0.3 | 0.5 | 0.6 | EXCELLENT | 0.7 |
| 16 | 0.7 | 0.9 | 0.8 | EXCELLENT | 0.4 |
| 17 | 8.5 | 8.5 | 8.0 | EXCELLENT | 0.5 |
| 18 | 2.0 | 8.0 | 3.0 | BAD | 2.5 |
| 19 | 5.5 | 8.0 | 7.5 | GOOD | 1.3 |
| 20 | 6.0 | 6.5 | 6.1 | BAD | 2.5 |

Figure 6:
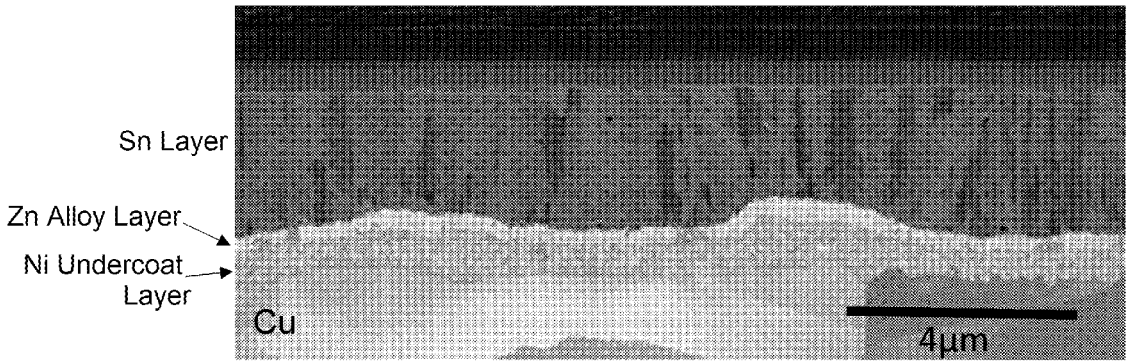
FIG. 6 It is a microphotograph of a section of a terminal material of Sample 15.

FIG. 6 is a microphotograph of a section regarding Sample 15: it can be confirmed that the undercoat layer (a nickel layer), the intermediate zinc layer (a zinc alloy layer), and the tin layer were formed in order from the base material side.

Figure 7:
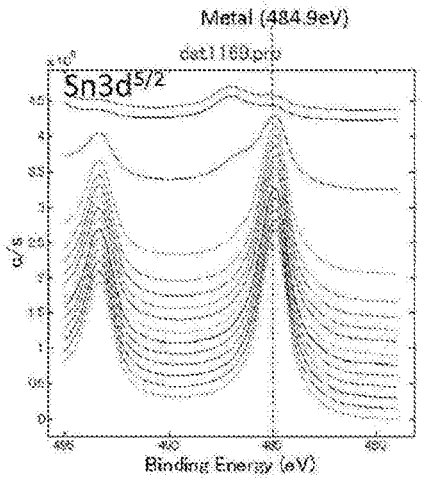
FIG. 7(*a*) and FIG. 7(*b*) They are analysis diagrams of a chemical state in a depth direction in a surface part of a terminal material of Sample 14; a part (a), FIG. 7(*a*), is an analysis diagram of tin, and a part (b), FIG. 7(*b*), is an analysis diagram of zinc.
Figure 7:
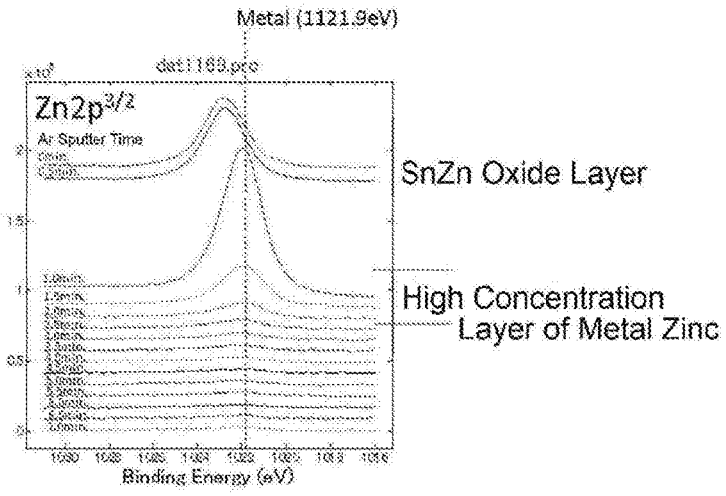

FIG. 7(*a*) and FIG. 7(*b*) are analysis diagrams of a chemical state in a depth direction of Sample 7. It can be deemed that, from a chemical shift of a binding energy, in a depth of 1.25 nm from the outermost surface the oxide (a tin zinc oxide layer) is a main constitute FIG. 7(*a*): from 2.5 nm, a high concentration layer of metal zinc is found and it can be found that metal zinc is a main constitute, FIG. 7(*b*).

From the results of Table 2, in Samples 1 to 3 in which the intermediate zinc layer was formed to have the thickness 0.1 μm to 5.0 μm inclusive and the zinc concentration rate 5 mass % or lower, the zinc concentration in the tin layer was 0.4 mass % to 15 mass % inclusive, and the corrosion potential was in a range of −500 mV to −900 mV against the silver-silver chloride electrode (Ag/AgCl electrode) which was the reference electrode: it can be found that Samples 1 to 3 have low corrosion current before heating for 0 to 1000 minutes and the bending workability is good.

Samples 4 and 5 in which the grain size was in a range of 0.1 to 3.0 μm in the tin layer had the lower corrosion current before heating for 0 to 1000 minutes than that of Samples 1 to 3 having thick grain size, so that the effect of preventing the galvanic corrosion is improved. Samples 6 and 7 in which the tin layer (the second tin layer) having the tin grain size 0.8 to 3.0 μm is stacked on the tin layer (the first tin layer) having the minute tin grain size 0.1 to 0.7 μm have the anti-corrosion effect equal to or higher than that of Samples 1 to 5, and moreover, and are improved in the connecting reliability since the contact resistance is lower. In Samples 8 to 13, since the intermediate zinc layer is zinc alloy including one or more among nickel, manganese, molybdenum, tin, cadmium, and cobalt; increase of the corrosion current is very small even though a corrosion test was continued for a longer time of 1000 to 3000 minutes; and the property of preventing aluminum from the corrosion for a long time is improved. In Samples 14 to 16, since the undercoat layer having the nickel content rate of 80 mass % or more is formed between the base material and the intermediate zinc layer with the thickness 0.1 μm to 5.0 μm inclusive, the better effect of preventing the galvanic corrosion is shown even after heating than Samples 1 to 15 which do not have the undercoat layer.

Among these, Samples 12 to 16 show especially good results in which the bending workability is good and the contact resistance is lower than the others; by maintaining at temperature 30° C. to 160° C. inclusive for a time 30 minutes to 60 minutes inclusive as a diffusion treatment, so that the surface metal zinc layer is formed to have the zinc concentration 5 at % to 40 at % inclusive and the thickness 1 nm to 10 nm inclusive in terms of $SiO_2$.

Sample 17 of a comparative example had low corrosion potential and high corrosion current since the intermediate zinc layer was not formed. In Sample 18, the thickness of the intermediate zinc layer is larger than 5.0 μm and the nickel content rate in the undercoat layer is low; so that the corrosion current value is considerably deteriorated after heating and the bending workability was bad: moreover, since the grain size is 0.1 μm or smaller in the tin layer, zinc was excessively diffused and the corrosion potential was −900 mV vs. Ag/AgCl or lower, so that the contact resistance is deteriorated. In Sample 19, since the undercoat layer is thin and the intermediate zinc layer is very thin, adhesion of the tin layer is deteriorated, and cracks are occurred when the bending is performed; moreover, the zinc concentration is low in the tin layer, so that the corrosion current value is high before heating, and the corrosion current value is further increased after heating. In Sample 20, the thickness of the undercoat layer is larger than 5 u, and the grain size is large in the tin layer; so that the zinc concentration in the tin layer was low, the corrosion current was high, and the cracks were occurred when the bending was performed.

INDUSTRIAL APPLICABILITY

It is possible to provide a tinned copper terminal material in which galvanic corrosion is not occurred as a terminal crimped to an end of an electrical wire formed from an aluminum wire material, a terminal formed from the terminal material, and an electrical wire end part structure using the terminal.

REFERENCE SIGNS LIST

1 tinned copper terminal material
2 base material
3 undercoat layer
4 intermediate zinc layer
5 tin layer
5*a* first tin layer
5*b* second tin layer

6 surface metal zinc layer
7 oxide layer
10 terminal
11 connector part
12 electrical wire
12*a* core wire
12*b* sheath part
13 core wire crimp part
14 sheath crimp part

The invention claimed is:

1. A tinned copper terminal material comprising an intermediate zinc layer formed from zinc or zinc alloy and a tin layer formed from tin or tin alloy which are layered in this order on a base material formed from copper or copper alloy, wherein the intermediate zinc layer consists of zinc alloy containing one or more among nickel, manganese, molybdenum, tin, cadmium, and cobalt, and the zinc concentration is not less than 65 mass % and not more than 95 mass %, the intermediate zinc layer has a thickness not less than 0.1 μm and not more than 5.0 μm, and the tin layer has a zinc concentration not less than 0.4 mass % and not more than 15 mass %.

2. The tinned copper terminal material according to claim 1, wherein corrosion potential is not more than −500 mV and not less than −900 mV to a silver-silver chloride electrode.

3. The tinned copper terminal material according to claim 1, wherein a grain size in the tin layer is not less than 0.1 μm and not more than 3.0 μm.

4. The tinned copper terminal material according to claim 1, wherein the tin layer is formed from a first tin layer arranged at a side to the base material and having a grain size not less than 0.1 μm and not more than 0.8 μm and a thickness not less than 0.1 μm and not more than 5.0 μm, and a second tin layer arranged above the first tin layer and having a grain size more than 0.8 μm and not more than 3.0 μm and a thickness not less than 0.1 μm and not more than 5.0 μm.

5. The tinned copper terminal material according to claim 1, further comprising a surface metal zinc layer formed on the tin layer, wherein the surface metal zinc layer has a zinc concentration not less than 5 at % and not more than 40 at % and a thickness not less than 1 nm and not more than 10 nm in terms of $SiO_2$.

6. The tinned copper terminal material according to claim 1, wherein an undercoat layer consists of nickel or nickel alloy is formed between the base material and the intermediate zinc layer, and the undercoat layer has a thickness not less than 0.1 μm and not more than 5.0 μm and a nickel content not less than 80 mass %.

7. A terminal formed from the tinned copper terminal material according to claim 1.

8. An electrical wire end part structure wherein the terminal according to claim 7 is crimped to an end part of an electrical wire formed from aluminum or aluminum alloy.

* * * * *